United States Patent [19]

Woudenberg et al.

[11] Patent Number: 4,664,098

[45] Date of Patent: May 12, 1987

[54] CARDIOPULMONARY RESUSCITATOR

[75] Inventors: Cornelius Woudenberg; Bruce A. J. Skinner, both of Auckland, New Zealand

[73] Assignee: Coromed International, Auckland, New Zealand

[21] Appl. No.: 615,815

[22] Filed: May 31, 1984

[30] Foreign Application Priority Data

Jun. 2, 1983 [NZ] New Zealand ..... 204459

[51] Int. Cl.[4] ..... A61H 7/00

[52] U.S. Cl. ..... 128/53; 178/30.2; 178/28

[58] Field of Search ..... 128/28, 30.2, 51–55

[56] References Cited

U.S. PATENT DOCUMENTS

| | | | |
|---|---|---|---|
| 3,307,541 | 3/1967 | Hewson | 128/53 |
| 3,351,052 | 11/1967 | Hewson | 128/53 |
| 3,364,924 | 1/1968 | Barkalow | 128/53 |
| 3,425,409 | 2/1969 | Issacson et al. | 128/28 |
| 3,481,327 | 12/1969 | Drennen | 128/30.2 |
| 3,509,899 | 5/1970 | Hewson | 128/53 |
| 3,651,801 | 3/1972 | Kullok | 128/53 |
| 3,896,797 | 7/1975 | Bucur | 128/53 |
| 4,361,140 | 11/1982 | Barkalow | 128/53 |

FOREIGN PATENT DOCUMENTS

| | | | |
|---|---|---|---|
| 1563994 | 3/1968 | France | 128/53 |

*Primary Examiner*—Richard J. Apley
*Assistant Examiner*—J. Welsh
*Attorney, Agent, or Firm*—Holman & Stern

[57] ABSTRACT

A device is described for performing mechanical cardiopulmonary resuscitation. The device comprises a housing which in use is secured to the chest of a patient, the housing and securing means providing inelastic encirclement of the patient's chest. Pneumatically operated pressing means projects from the housing to bear on the patient's breast bone and suitable valving is contained in the housing to apply cyclic displacement of the pressing means.

4 Claims, 9 Drawing Figures

Fig. 1.
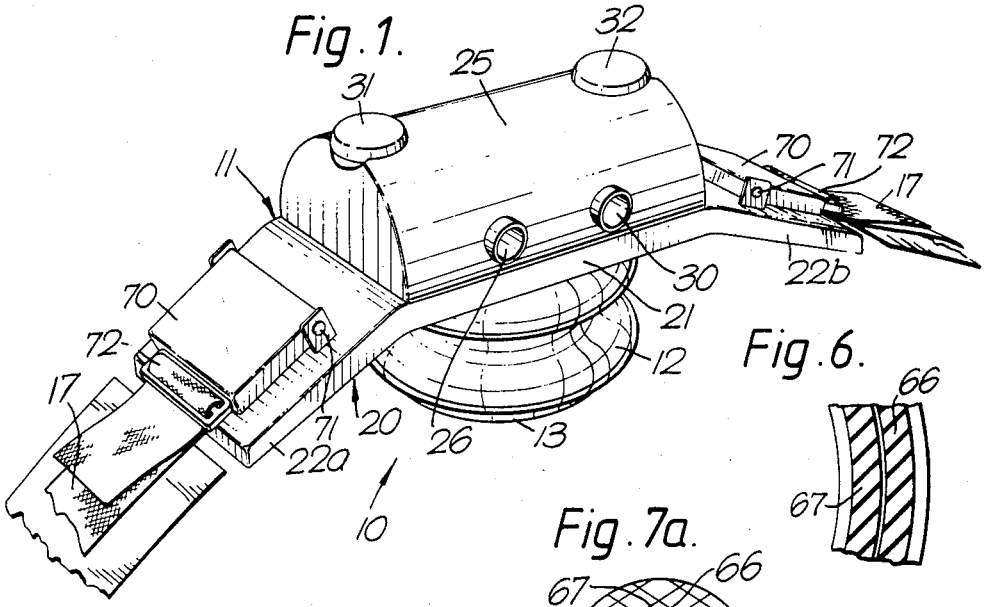
Fig. 6.
Fig. 7a.
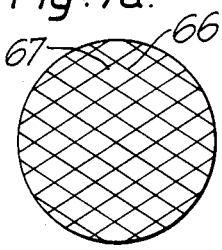
Fig. 2.
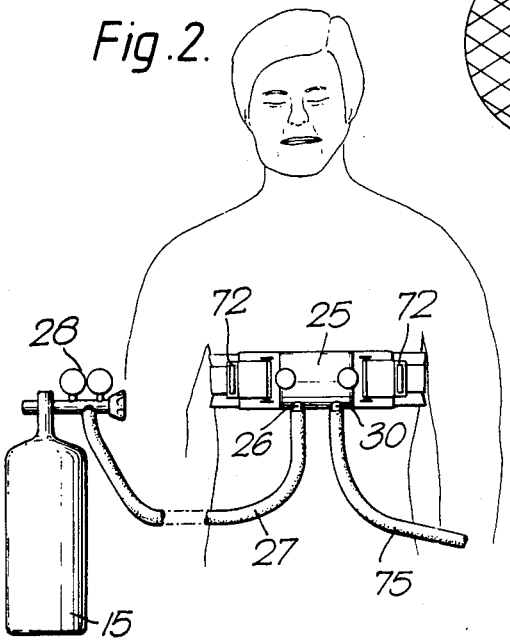
Fig. 7b.
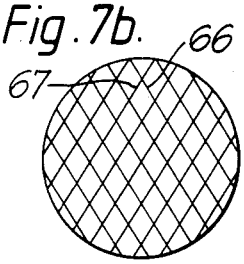

CARDIOPULMONARY RESUSCITATOR

FIELD OF THE INVENTION

This invention relates to cardiopulmonary resuscitation devices.

DESCRIPTION OF THE PRIOR ART

A number of forms of mechanical apparatus have been proposed in the past for performing Cardiopulmonary Resuscitation.

U.S. Pat. Nos. 3,209,747 (Guenter); 3,965,893 (Ragailler) and 4,338,924 (Bloom) show forms of such apparatus in which a rigid plunger is mounted on a somewhat bulky arm extending both vertically and horizontally from a base member. The plunger may only move along a fixed axis and care must be taken to maintain the patient in the correct relationship to the plunger for if the patient moves the plunger can engage, and even break, the patient's ribs. No means is provided to restrain the patient's chest against lateral displacement.

U.S. Pat. Nos. 3,782,371 (Derouineau) and 3,461,858 (Michelson) show further similar forms of apparatus in which the plunger is mounted on a U-shaped bracket which completely surrounds, but does not bear on, the chest of the patient.

U.S. Pat. No. 3,454,000 (Bird) describes a form of apparatus intended for the administration of pulmonary chemotherapy. This patent is relevant to the extent that the construction incorporates a belt which encompasses the patient, portions of the belt being cyclically inflatable. The belt does not, however, provide the type of localised force necessary for cardiopulmonary resuscitation and further the valving necessary to provide the cyclic pressurisation of the belt is provided in a separate, remote pack.

U.S. Pat. Nos. 3,307,541; 3,351,052 and 3,509,899 (Hewson) show forms of cardiopulmonary resuscitation devices in which the plunger is mounted in housing strapped to the patient's chest. In all cases the plunger moves along an axis fixed with respect to the housing and further is operated by valving included either in a remote pack or a base board.

Our research has indicated that to perform effective and efficient mechanical cardiopulmonary resuscitation a device must have the following attributes:

1. It must be as small as possible.
2. It must be portable while in place on the patient.
3. It must be provided as a single unit requiring only a separate supply of compressed gas for its operation.
4. It must restrain the patient's chest against lateral displacement during operation of the plunger mechanism so that the full effect arising from the chest displacement is realized.

All of the prior art constructions described above are deficient in at least one of the above respects and we have therefore attempted to overcome the deficiencies in the present invention.

Accordingly it is an object of the present invention to provide a cardiopulmonary resuscitation device which will go at least someway in overcoming the deficiencies in the prior art or which will at least provide the public with a useful choice.

BRIEF DESCRIPTION OF THE INVENTION

Accordingly the invention consists in a cardiopulmonary resuscitation device engageable with a supply of compressed gas, said device comprising;

mounting means;

pneumatically operable pressing means mounted on said mounting means and projecting therefrom, said pressing means having a contact surface reciprocable toward and away from said mounting means, the alignment of said contact surface being capable of at least limited variation with respect to said mounting means;

Valving means located on or within said mounting means, said valving means being operable to intermittently supply compressed gas to said pressing means and thereby cause reciprocal movement of said contact surface; and securing means to locate said mounting means so that, in use, said contact surface engages over the breast bone of a patient, said securing means in conjunction with said mounting means providing inelastic encirclement of said patient's chest.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which:

FIG. 1 shows a perspective view of the main operative elements of a cardiopulmonary resuscitation device according to the invention;

FIG. 2 shows a plan view of the apparatus depicted in FIG. 1 in place on the chest of a patient;

FIG. 6 shows a sectional view through the wall of pressing means incorporated in the cardiopulmonary resuscitator depicted in the drawings; and FIGS. 7*a* and 7*b* show diagrammatical plan views of reinforcing incorporated in the pressing means forming part of the cardiopulmonary resuscitation device herein described, in two alternative configurations.

DETAILED DESCRIPTION OF THE INVENTION

Figure 3:
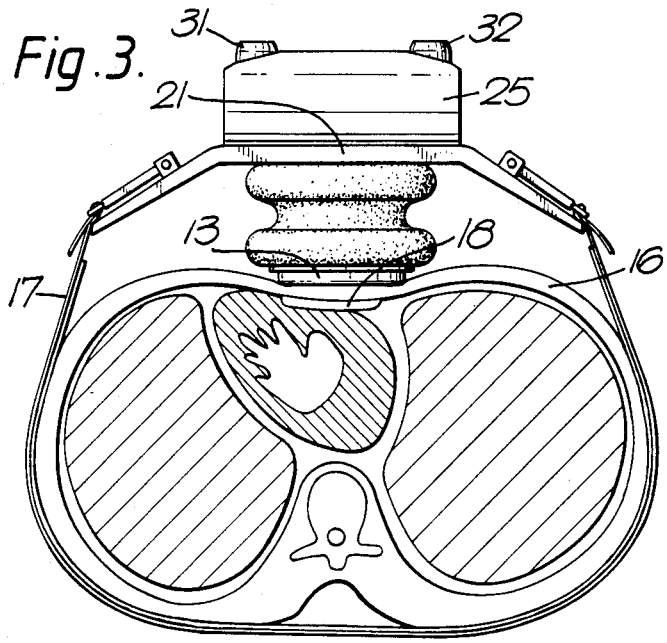
FIG. 3 shows a cross sectional view through the chest of a patient with the resuscitation device according to the invention in position thereon.

Referring to the drawings and in particular to FIGS. 1 to 4, according to the invention, a cardiopulmonary resuscitation device 10 is provided which comprises mounting means 11; a pneumatically operable pressing means 12 mounted on the mounting 11 and projecting therefrom, the pressing means 12 having a contact surface 13 which is reciprocal toward and away from the mounting means. As described hereinafter the construction and arrangement of the pressing means 12 is such that the alignment of the contact surface 13 is capable of at least limited variation with respect to the mounting means 11 and thus, in use, the contact surface 13 may, to some extent, "self align" itself independently of the mounting means 11.

Figure 4:
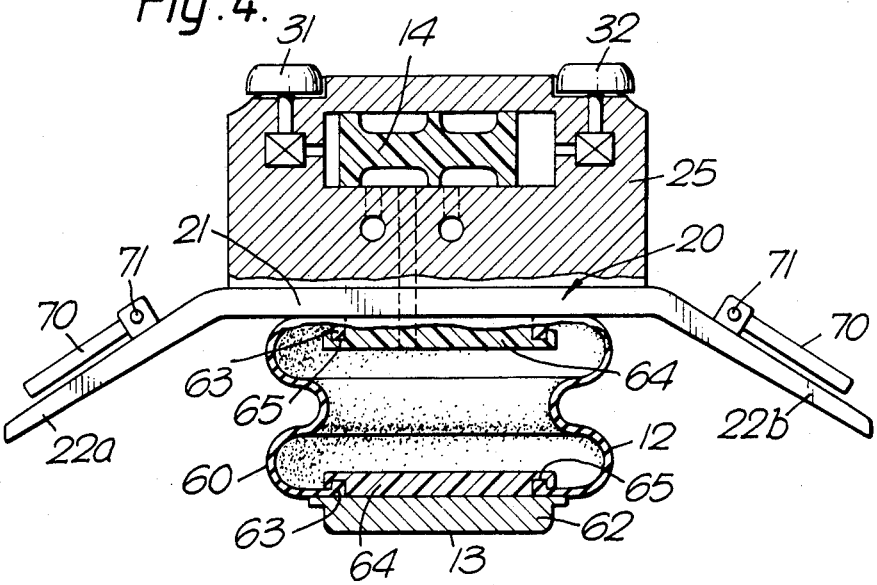
FIG. 4 shows a cross sectional view through the resuscitator shown in FIG. 1.

The apparatus further includes valving means indicated generally by reference numeral 14 in FIG. 4, the valving means 14 being operable to intermittently supply compressed gas from a compressed gas supply 15 (FIG. 2) to the pressing means 12 and thereby cause reciprocal movement of the contact surface 13.

The mounting means 11, pressing means 12 and contact surface 13 are maintained in position with respect to a patient's chest 16 by securing means 17. In use the elements above described are positioned so that the contact surface 13 engages over the breast bone 18 of the patient. The securing means 17, in combination with the mounting means 11, provides a complete, inelastic encirclement of the patient's chest.

As can be seen the mounting means 11 comprises a base 20 having a centre section 21 and two side sections 22*a* and 22*b* which project on either side of the central section 21 and are angled downwardly with respect to the centre section. The preferred angle between the side sections 22*a*, 22*b* and the centre section 21 is about 30° and the total distance between the outer extremeties of the side sections 22*a* and 22*b* is approximately 30 cm. It will be appreciated however that some variation of this configuration may, in some circumstances, be necessary so that the apparatus herein described can be used effectively on patients of varying sex and size.

Mounted on the centre section 21 of the base member 20 is a valve block 25 which encloses the valving means 14 and also serves to mount the pressing means 12. The exterior of the valve block 25 includes a compressed gas inlet 26 which is engageable with the compressed gas supply 15 via air line 27 and regulator 28. Also shown on the exterior of the valve block 25 is an exhaust 30 and control knobs 31 and 32, the function of which will be described hereinafter.

Figure 5A:
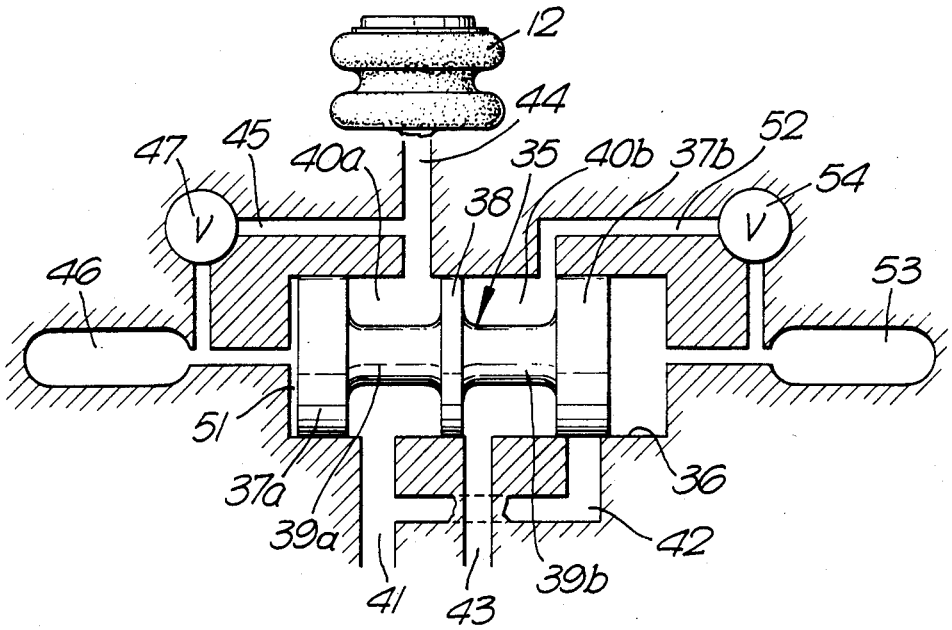
FIGS. 5*a* and 5*b* show schematic views of valving means incorporated in the apparatus depicted in FIGS. 1 to 4, in two alternative configurations.
Figure 5B:
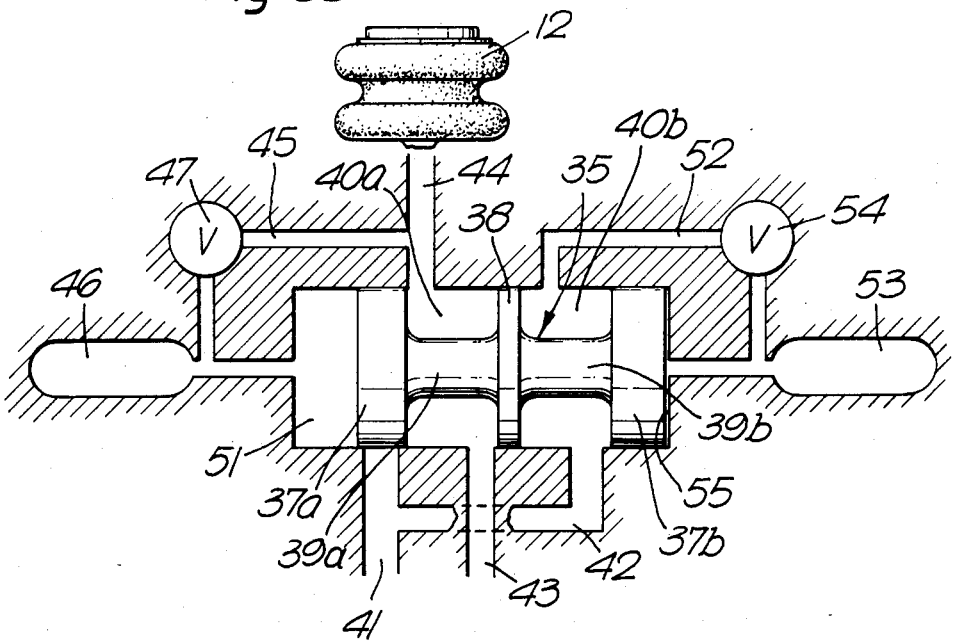

Referring now to FIGS. 5*a* and 5*b*, the valving means 14 comprises a shuttle member 35 which is reciprocably displaceable within a closed cylinder 36 formed within the valve body 25. The shuttle member 35 has two cylindrical end mounting sections 37*a* and 37*b* and a central section 38. The sections 37*a* and 38 and 38 and 37*b* are interconnected by spindles 39*a* and 39*b* respectively which are of lesser diameter and allow compressed gas to flow between the various elements of the circuitry in a manner which will be hereinafter described, suffice to say that two chambers 40*a* and 40*b* are defined between shuttle member 35 and the cylinder 36.

The gas inlet 26 is attached to line 41 of the circuit depicted, line 41 leading into chamber 40*a* and having a sub-branch 42 leading into chamber 40*b*. Line 43 communicates with exhaust and can be placed in communication with either chamber 40*a* or 40*b* depending on the position of the shuttle member 35 within cylinder 36.

The chamber 40*a* communicates with the pressing means 12 through line 44. Branching off line 44 is a sub-branch 45 which communicates with an air space 46 through a variable flow valve 47. Valve 47 is operated through control knob 41. Air space 46 communicates with chamber 51 formed between the walls of the cylinder 36 and the reverse side of end section 37*a* of the shuttle member 35.

In a similar manner circuit line 52 leads from the chamber 40*b* and communicates with air space 53 via variable flow valve 54. The air space 53 in turn communicates with chamber 55 which is defined between the walls of the cylinder 36 and the reverse side of end section 37*b* of the shuttle member 35. The control valve 54 is operated by rotation of the control knob 32.

The operation of the valving 14 is as follows:

With the shuttle member 35 initially in the position shown in FIG. 5*a*, compressed gas is applied to the fitting 26 resulting in a flow of compressed gas through line 41. The compressed gas passes through chamber 40*a* and inflates the pressing means 12 thus forcing contact surface 13 against the breast bone 18 of the patient. At the same time a flow of gas passes through circuit 45, through valve 47 and into air space 46. When the air space 46 is full the chamber 51 begins to fill and in doing so displaces the shuttle member 35 to the right and thus into the position shown in FIG. 5*b*. It will be appreciated that while the pressing means 12 is under inflation, no compressed gas passes into chamber 40*b* as the port between line 42 and the chamber 40*b* is covered by end section 37*b* of the shuttle member.

When the shuttle member is displaced into the position shown in FIG. 5*b*. the centre section 38 of the shuttle member 35 is displaced to the opposite side of the port between exhaust line 43 and chamber 40*a* and thus the interior of the pressing means 12 is placed in communication with the exhaust and thus releases pressure upon the patient's breast bone. Displacement of the shuttle member also blocks the inlet gas from the chamber 40*a* and places the inlet line 41 in communication with chamber 40*b* through branch line 42. This flow of compressed gas then passes through circuit line 52, through variable control valve 54 and fills air space 53. When the air space 53 is filled the chamber 55 then undergoes inflation which has the effect of displacing the shuttle member 35 to the left once again to allow further inflation of the pressing means 12.

It will be appreciated that the adjustment of valves 47 and 54 control the rate at which the air spaces 46 and 53 are filled. Thus the valve 47 which is displaced by rotation of the control knob 31 is used to vary the pressure within the pressing means 12 and thus the degree of pressure applied to the chest of the patient. The control valve 54, the displacement of which is effected by rotation of control knob 32 controls the speed at which the shuttle is displaced back to the position shown in FIG. 5*a* and thus controls the speed of reciprocal movement of the pressing means 12.

It will be appreciated that in both cases the valves 47 and 54 could, if desired, be replaced by preset aperture valves incapable of adjustment. It is desirable, however, that the variable valve 47 be provided in all cases.

The pressing means 12 preferably includes a flexible wall section 60 which links the contact surface 13 to the mounting means 11, the flexible wall 60 thus allowing for the self-alignment of the contact surface 13. In the form shown the flexible wall 60 is provided in the form of an annular concertinered bladder which is preferably formed from a reinforced rubber. One end of the bladder 60 is clamped against the valve block 25 by clamping member 64 while a substantially inelastic member 62 which includes contact surface 13 is clamped to the opposite end of the bladder 60 by a further clamping member 64.

As can be seen the internal surface at either end of the bladder 60 is provided with a peripheral lip 63 and the clamping members 64 each include a corresponding peripheral channels 65 which, in operation clamp over the peripheral lips 63 to locate and retain the bladder 60 with respect to both the valve block 25 and the contact member 62. The actual clamping can be provided by any suitable means but preferably by through bolts (not shown).

The construction of the bladder 60 is preferably such that the peripheral wall thereof is elastic along the axis of movement of the contact surface 13, but is substantially inelastic perpendicular thereto. To this end substantially inelastic textile reinforcing is preferably included within the flexible wall 60 which allows the wall section to expand longitudinally but restrains the wall section against lateral displacement.

Referring to FIGS. *7a* and *7b*, the alignment of the textile plies 66 and 67 are shown in the uncompressed and compressed state respectively. In the uncompressed state the plies 66 and 67 criss-cross at a relatively wide angle when viewed side on. As the bladder is inflated the angle between the plies narrows but because each of the plies 66 and 67 is restained at their ends, there is little or no outward displacement allowed i.e. displacement perpendicular to the plane of the diagram.

The above configuration is important as for the efficient operation of the apparatus is it necessary that the compressed gas be used to apply reciprocal movement of the contact surface 13 and not lateral displacement of the bladder.

The securing means 17 preferably comprises an inelastic webbing belt which is adjustably engageable with the end sections 22*a* and 22*b* of the base member 20. To this end mating male/female buckle sections are applied to the mounting means 11 and the securing means 17 and, in the form shown, female buckle members 70 are pivotally attached at 71 to the end sections 22*a* and 22*b* of the base member 20. The corresponding male buckle sections 72 are fixed to opposite ends of the belt 17 so as to allow engagement of the belt with the operative parts of the apparatus and allow inelastic encirclement of the patient's body.

It will be appreciated that by providing adjustments on both sides of the mounting means 11 the apparatus can be readily and rapidly positioned so that the contact surface 13 is correctly positioned with respect to the breast bone 18 of the patient. The pivotal mounting of the buckle sections 70 also allow the differing girths of patients to be accommodated to some extent.

The belt 17 is approximately 10 cm wide. We have found this width of belt to be particularly suitable as it prevents substantial rocking of the mounting means, i.e. during operation of the apparatus. Further, the width of belt 17 is such that, when the belt is raised on the chest to contact the patient's armpits, the contact surface 13 is positioned longitudinally on the breast bone in the optimum position for resuscitation.

In use, when a patient's heart arrests the resuscitation device herein described is fixed in position by means of the inelastic belt 17 so that the contact surface 13 of the pressing means is placed in position over the patient's breast bone 18. Precise positioning is enabled by the buckles between the belt 17 and the housing means 11. With the apparatus properly positioned, line 27 is connected between the gas inlet fitting 26 and a supply 15 of compressed gas, preferably oxygen. A regulator 28 is provided to regulate the pressure of gas supplied through line 27 and a suitable setting is generaly about 50 psi. A further line 75 may be fitted to the exhaust outlet 30 or alternatively a simple silencer applied thereto.

As compressed oxygen flows through the line 27, the valving means 14 ensures reciprocal movement of the contact surface 13 and thus intermittent compression of the patient's breast bone 18.

It is well known that the desired rate of compression for cardiopulmonary resuscitation is about 60 pulses per minute. This speed can be precisely set by actuation of control knob 32. The actual compression distance will vary according to patient and this can be set, to some extent, by operation of control knob 31 which controls the amount of inflation of the pressing means 12.

It will thus be appreciated that the present invention provides a simple yet effective form of cardiopulmonary resuscitator. The resuscitator, at least in the preferred embodiment described, has the following advantages:

1. The incorporation of an air inflated bladder to impart the pressing movement means that the actual contact surface can self-align itself over the patient's breast bone and thus avoid the common disadvantage heretofore of the pressing element disengaging itself from the breast bone and causing damage to the patient's ribs. Further, the use of air as the compression means provides some inbuilt "shock absorbing".
2. The incorporation of the valving within the mounting which is strapped on the patient's chest makes the apparatus extremely compact and means that the patient can be readily moved with the apparatus in position without the need to cease resuscitation. The compact nature of the apparatus also allows it to be fitted in confined spaces.
3. The complete inelastic encirclement of the patient's body prevents any lateral expansion of the patient's chest during resuscitation resulting in far more effective resuscitation.

What is claimed is:

1. A cardiopulmonary resuscitation device engageable with a supply of compressed gas, said device comprising;

inelastic mounting means engageable over a patient's chest;

pneumatically operable self aligning pressing means mounted on said mounting means and projecting therefrom, said pressing means having a contact surface arranged for contact with a patient3 s chest which is reciprocable toward and away from said mounting means along a pressing axis, and a flexible wall section extending generally in the direction of said pressing axis to mount said contact surface on said mounting means, said flexible wall section being the sole operative link between said contact surface and said mounting means such that, the said alignment of said contact surface is capable of at least limited variations of angles with respect to said mounting means;

valving means located on said mounting means, said valving means being operable to intermittently supply compressed gas to said pressing means and thereby cause reciprocal movement of said contact surface along said pressing axis; and a flexible inelastic belt engageable with said mounting means to locate said mounting means so that, in use, said contact surface engages over the breast bone of a patient, said belt intimately contacting the patient's body over the greater part of its length and, in conjunction with said mounting means, provided inelastic encirclement of said patient's chest.

2. A device as claimed in claim 1 wherein said flexible wall section is included in a bladder, said bladder being elastic along said pressing axis but substantially inelastic along an axis perpendicular thereto.

3. A device as claimed in claim 1 wherein said valving means comprises a valve body; a shuttle member reciprocable within said valve body; and pneumatic cirucitry provided within said valve body which in conjunction with said shuttle member, intermittently delivers a compressed gas to said pressing means.

4. A device as claimed in claim 3 wherein said belt is adjustably engageable with said mounting means at either side thereof spaced points thereon.

* * * * *